US009806449B2

(12) United States Patent
Hachadorian

(10) Patent No.: US 9,806,449 B2
(45) Date of Patent: Oct. 31, 2017

(54) ELECTRICAL CONTACT

(75) Inventor: Gary Hachadorian, Frankfurt am Main (DE)

(73) Assignee: Hachadorian Design & Calculation GmbH (DE)

( * ) Notice: Subject to any disclaimer, the term of this patent is extended or adjusted under 35 U.S.C. 154(b) by 0 days.

(21) Appl. No.: 13/823,033

(22) PCT Filed: Sep. 13, 2011

(86) PCT No.: PCT/EP2011/065879

§ 371 (c)(1),
(2), (4) Date: Mar. 13, 2013

(87) PCT Pub. No.: WO2012/035030

PCT Pub. Date: Mar. 22, 2012

(65) Prior Publication Data

US 2013/0171892 A1 Jul. 4, 2013

(30) Foreign Application Priority Data

Sep. 13, 2010 (DE) ..... 10 2010 037 498

(51) Int. Cl.
*H01R 13/64* (2006.01)
*H01R 13/04* (2006.01)
(Continued)

(52) U.S. Cl.
CPC ..... *H01R 13/04* (2013.01); *H01R 13/052* (2013.01); *H01R 13/111* (2013.01);
(Continued)

(58) Field of Classification Search
CPC .. H01R 13/6315; H01R 13/111; H01R 13/052
(Continued)

(56) References Cited

U.S. PATENT DOCUMENTS 4,778,404 A 10/1988 Pass
5,201,663 A * 4/1993 Kikuchi ..... H01R 13/6315 439/248
(Continued)

FOREIGN PATENT DOCUMENTS

BE 832 877 A1 12/1975
DE 19 755 A1 9/1960
(Continued)

OTHER PUBLICATIONS

International Search Report dated Dec. 15, 2011, as issued in corresponding International Patent Application No. PCT/EP2011/065879 (English translation—6 pages).
(Continued)

*Primary Examiner* — Felix O Figueroa
(74) *Attorney, Agent, or Firm* — Barnes & Thornburg LLP; Jeffrey R. Stone

(57) ABSTRACT

The invention relates to an electrical contact for an electrical plug connection, said contact having a flexible element between a connecting region fixed in a housing and a movable contact region. In the electrical contact, the movement of the contact region and/or the deformation of the flexible element in the direction of an axis extending parallel to the plugging direction of the contact region is/are limited. Such contacts are provided in particular in power sockets for motor vehicles for creating an electrical connection to a trailer.

10 Claims, 10 Drawing Sheets

(51) Int. Cl.

| | |
|---|---|
| ***H01R 13/05*** | (2006.01) |
| ***H01R 13/11*** | (2006.01) |
| ***H01R 13/631*** | (2006.01) |
| *H01R 35/00* | (2006.01) |
| *H01R 43/24* | (2006.01) |

(52) U.S. Cl.
CPC ..... *H01R 13/6315* (2013.01); *H01R 35/00* (2013.01); *H01R 43/24* (2013.01)

(58) Field of Classification Search
USPC ..... 439/246–248, 843, 252
See application file for complete search history.

(56) References Cited

U.S. PATENT DOCUMENTS

| | | | | |
|---|---|---|---|---|
| 5,865,641 | A | 2/1999 | Swart et al. | |
| 5,951,314 | A * | 9/1999 | Durand-Cochet et al. | 439/252 |
| 6,186,810 | B1 * | 2/2001 | Barnabe et al. | 439/252 |
| 7,452,226 | B2 * | 11/2008 | Rabotti | 439/248 |
| 7,527,532 | B2 | 5/2009 | Northey | |

FOREIGN PATENT DOCUMENTS

| | | | |
|---|---|---|---|
| DE | 11 35 071 | A | 8/1962 |
| DE | 41 04 215 | A1 | 8/1992 |
| DE | 4104215 | A1 | 8/1992 |
| DE | 198 28 983 | A1 | 1/1999 |
| DE | 199 41 793 | A1 | 3/2000 |
| DE | 600 24 359 | T2 | 6/2006 |
| EP | 0 492 479 | A2 | 7/1992 |
| FR | 2 545 993 | A1 | 11/1984 |
| FR | 2 783 098 | A1 | 3/2000 |
| GB | 1 389 301 | | 4/1975 |
| JP | 58 082779 | U | 6/1983 |
| JP | H02 56373 | U | 4/1990 |
| JP | H02 84289 | U | 6/1990 |
| JP | 2002 025697 | A | 1/2002 |
| WO | 98/29751 | A1 | 7/1998 |
| WO | 2007/038973 | A1 | 4/2007 |

OTHER PUBLICATIONS

German Office Action dated Aug. 25, 2011 from corresponding German Application No. 10 2010 037 498.9; 7 pgs.

* cited by examiner a b

ELECTRICAL CONTACT

RELATED APPLICATIONS

This is the U.S. national stage application which claims priority under 35 U.S.C. §371 to International Patent Application No.: PCT/EP2011/065879, filed on Sep. 13, 2011, which claims priority to German Patent Application No. 10 2010 037 498.9, filed on Sep. 13, 2010, the disclosures of which are incorporated by to reference herein their entireties.

The present invention relates to an electrical contact having a round cross section, in particular an electrical pin or socket contact, for an electrical plug connection, said electrical contact having a flexible element between a connecting region fixed in a housing and a movable contact region. In the electrical contact, the movement of the contact region and/or the deformation of the flexible element in the direction of an axis parallel to the plugging direction of the contact region is prevented, but the movement and/or the deformation in any direction orthogonal to the plugging direction is possible. Such contacts are provided in particular in power sockets for motor vehicles for creating an electrical connection to a trailer.

Electrical contacts having a flexible element between the contact region and the connecting region are already known from the prior art, inter alia from British patent No. GB 1389301 A. There, a socket contact is described having a flexible element that has a braided metal tube and a resilient component that enable a movement of the contact in the plugging direction. In French patent No. FR 2545993A1, a flexible electrical contact is described which is composed of a fixed part and a movable part in the form of a spring and is movable in the axial direction. An electrical contact is also described in international patent application WO 98/29751, wherein a flexible element is used as an electrical connection between the contact region and the connecting region. A coil spring allows a movement of the electrical contact in the axial direction in this arrangement as well.

In the case of multi-pin connections, the electrical contacts must have a floating bearing in order to compensate tolerances of the connector system, because otherwise the required plugging force of the connector becomes too high and the abrasion of the contacts is accelerated. Some connectors in the automotive industry, for example, are designed for up to 5000 plugging cycles, so that the movability of the electrical contacts inside the socket is very important here.

Additionally, however, it is expected that the connecting region of the electrical contacts is permanently and reliably sealed to the outside. For this, the socket must be optimally sealed against moisture. The reason for this is that moisture can be transported over long distances in the space between cables or between the strands in the cable due to capillary forces.

From the prior art, single-wire seals are known that seal individual electrical contacts. These seals must additionally compensate for the movement of the contacts and must reliably prevent the ingress of moisture. Within the housing, the electrical contacts are often fixed with latching hooks. For heavy-duty service, however, an additional locking mechanism is necessary, in order to prevent unlocking of the contacts within the connector.

For sealing and locking, the electrical contacts are preferably fixed in the housing of the socket by overmolding. In the process, the electrical contacts, optionally with the wires already connected, are placed in a molding die and either an elastomer or a plastic material is injected around the electrical contacts. Both materials used here have particular advantages but also disadvantages.

Elastomer overmolding has the advantage that the electrical contacts remain movable in the overmold material, but the wires are nonetheless very well sealed. A disadvantage, however, is the fact that the movability of the contacts is dependent on the temperature of the material. Due to the stress on insertion or removal of the plug, the contacts can be torn out of the material. In addition, the elastomer materials used are expensive and the achievable tolerances of an elastomer are greater than with a plastic material.

Plastic overmolding has the advantage that the wires are almost perfectly sealed, and the electrical contacts are firmly fixed in the overmold. There is no risk when using the plug that the electrical contacts may to be torn out from the material. A disadvantage of using plastic overmoldings is that the electrical contacts are rigidly fixed and under mechanical stress no compensation of the positions of the contacts is possible.

The object of the present invention was therefore to overcome the disadvantages of the known prior art and to provide an electrical contact which remains movable within a plastic overmold and additionally enables easy alignment within a socket. A movement or deformation of the electrical contacts parallel to the plugging direction of the contact region should be limited in this arrangement to such an extent that it would no longer need to be taken into consideration, so that a plug can easily be engaged and pulled, but the contacts nonetheless remain flexible within the housing. A plastic overmold also brings further economic advantages, since fewer components are required in the manufacture of the socket and the amount of assembly work and tool costs can be reduced.

This object is achieved by a self-aligning electrical contact with a round cross-section according to claim 1. The inventive electrical contact with a round cross section, in particular an electrical pin or socket contact, for an electrical plug connection comprises a flexible element between a connecting region fixed in a housing and a movable contact region, wherein the movement of the contact region and/or the deformation of the flexible element in the direction of an axis parallel to the plugging direction of the contact region is prevented, but made possible in any direction orthogonal to the plugging direction.

Such a contact according to the invention is intended in particular for power sockets in motor vehicles for creating an electrical connection to a trailer. This electrical contact can be used for any application in which a fixing of the connecting region is necessary. This may also be the case, for example, when the connecting region of the electrical contact is mounted in a printed circuit board. This may be the case in some power socket adapters and junction boxes. These can then likewise be fixed within a plastic overmold.

The movement of the contact region and/or the deformation of the flexible element are prevented according to the invention in the direction parallel to an axis of the plugging direction of the contact region. The term "plugging direction" as used in the present invention shall be understood to mean a direction along an axis parallel to the relative movement of two contact faces during the connection of the connector system. For the case that the contact region is designed as a socket contact, this is the direction in which a plug is inserted into the contact region. This plugging direction is usually parallel to the longitudinal axis of the electrical contact (axial). To accomplish this, the flexible element may be designed as a spring, the movement of the spring in the direction of an axis parallel to the plugging direction being immediately limited by various stops or being designed so as to be rigid. The bias of the flexible element therefore plays no significant role for the insertion or pull-out force of the contact.

Ideally, the movement of the contact region in the plugging direction should be prevented altogether. However, this would also be afflicted with certain disadvantages. The production of such a contact, the movement of which is completely prevented since there are no distances between stops and contact, would be technically difficult to implement. If no distance existed between the stops and the contact region, no movement or only a very limited movement would be possible orthogonal to the plugging direction, due to the friction. Due to the small distance between the stops and the contact region and the increased rigidity of the flexible element in the plugging direction, the contact region is capable of adjusting to the position of the other contacts before the movement of the contact region is prevented by the friction on the stop.

When a socket contact is used that is designed for pin contacts with a diameter of 3.5 mm, the distance between a stop and the contact region of the electrical contact is preferably 0.1 to 0.9 mm. However, in normal usage, due to the rigidity of the flexible element the contact region should not reach the stops.

The contact region is in this case the electrical interface of the plug connection. This contact region may be formed as a socket contact or as a pin contact. This plug connection must be rated for up to 5000 plugging cycles, and therefore a movability of the contacts is essential in this case. In some connector systems, the commercially available low-price plugs are often manufactured carelessly. When using such poorly made plugs, which are to be then connected to high-quality power sockets (for example, directly on the car), it is often not possible to connect the two connector components without adjusting the electrical contacts. The movement of the contacts must then also be capable of compensating for the inaccuracies that may occur in the production of low-price plugs.

The connecting region is the interface between the connector and the wiring kit. The connecting region is fixed in a housing, for example of a power socket. For the case in which the connecting region is designed as an additional plug connection, the number of plugging cycles to be expected for same is only 10 to 20. For this reason, the connecting region may be fixed even if the connecting region serves as a contact region for a further plug connection.

In an advantageous embodiment, the connecting region of the electrical contact is fixed within an overmold. In an alternative embodiment, the connecting region is fixed by press-fitting in a housing part. This has the advantage that the contacts are fixed, and cannot be torn from the material during use of the connector system. Moreover, the wires are very well sealed, since no moisture can penetrate into the housing. At the same time, however, it is ensured via the flexible element of the electrical contact, which flexible element is not fixed, that the contacts remain movable in the non-axial direction.

In a further alternative embodiment, the connecting region is accommodated in a printed circuit board. This may be the case in some socket adapters and junction boxes. Same may then also be fixed in a plastic overmold.

In a further advantageous embodiment, the electrical contact is designed in one piece. This facilitates the production of the contacts. In addition, when using multi-part contacts, the contact resistance is significantly increased by the interfaces of the individual parts.

In a further advantageous embodiment, the flexible element is designed as a coil spring, wherein the cross section of the coil spring is preferably rectangular. This embodiment is particularly advantageous because the coil spring itself prevents deformation in the plugging direction. Due to the moment of area of the second order of a rectangle, one bending direction is more rigid than the other. In an alternative embodiment, the flexible element is designed as two orthogonal leaf springs. These orthogonal leaf springs are flat metal strips which are prestressed in an arcuate shape.

In an alternative advantageous embodiment, the electrical contact according to the invention is enclosed in a sleeve, and movement of the flexible element of the electrical contact is limited by stops. The stops can be located either on the flexible element in this arrangement or on the outer sleeve. However, it is advantageous if the stops are integrated into the sleeve and fix the flexible element of the electrical contact within the sleeve, so that the axial movement and/or deformation of the flexible element along an axis parallel to the plugging direction is limited. It is preferred in this context if stops designed in the form of protrusions are present on two or more faces of the electrical contact. In a preferred embodiment, the movement of the flexible element is limited by the fact that the connecting region is fixed in the housing and stops are provided on the side opposite the connecting region that fix the contact region axially.

Another advantage of such a sleeve is that the electrical contacts can be press-fitted into a seat in a housing part. Through this transition fit between a seat in the housing of a power socket and the sleeve in which the electrical contact is enclosed, an additional seal is created.

In a further alternative embodiment, a movement of the contact region of the electrical contact is limited by at least one stop, the stops preferably being integrated into the sleeve, and/or at least one stop being formed by a coil spring as part of the flexible element. In order to limit the axial movement of the contact region within the sleeve, it is preferred when stops are present on two or more faces of the contact region. A stop may be preferably formed in that the housing is sufficiently enclosed that the contact region cannot be pulled out from the housing. On the opposite side between the contact region and the flexible element radially arranged stops in the form of protrusions may likewise be present, which prevent the contact region from being capable of being moved in the axial direction. Alternatively, a coil spring in the flexible region can be designed such that the coil spring itself functions as a stop, because the movement of the contact region may be limited by a slight compression of such a spring. The travel of such a spring (the difference between the unloaded and the fully compressed spring) is preferably 0.1 to 0.5 mm.

In a further advantageous embodiment, flexible centering elements are present that center the contact region of the electrical contact within the sleeve, the centering elements preferably being integrated into the sleeve, and/or the centering elements being integrated into the contact region, and/or the centering elements being designed with sharp edges so that they function at the same time as stops. This allows easy self-alignment of the electrical contact so that the contact region is centrally spring-loaded within the sleeve. The centering elements may be designed either [sic] as outward protrusions of the contact region and thereby create an all-around constant distance from the surrounding sleeve. However, it is particularly preferred when the centering elements are formed as inward protrusions of the sleeve and thereby enable a constant distance of the contact region from the sleeve. It is preferred in this arrangement if the centering elements are flexible, so that a certain amount of movement in any direction orthogonal to the plugging direction is still possible during a plugging operation. The centering elements may alternatively be designed with sharp edges, so that they operate at the same time as a centering element and as a stop. The movement of the contact region can thus be limited in the axial direction and at the same time the contact region can be centered within the sleeve.

It is particularly preferred according to the invention when the contact region of the electrical contact is enclosed in a sleeve made of an elastic material. As a material for such a sleeve, spring steel can for example be used, which in comparison to other steels has a higher strength and moreover has a certain elasticity because of special alloys. It is also preferred to use fibrous composite materials, in particular glass-fiber reinforced plastics. These are fiber-plastic composites made from a plastic material, such as a thermosetting unsaturated polyester resin, epoxy resin or polyamide and glass fiber.

In a further advantageous embodiment, movement of the contact region of the electrical contact is prevented by an additional housing part. This additional housing part is affixed orthogonal to the plugging direction on the contact region of the electrical contact and is connected to the remaining housing portion of a power socket or to the sleeve surrounding the electrical contact. It is preferred in this arrangement if the contact region of the electrical contact can engage in latching elements on the additional housing part, which at the same time function as stops. This creates an extra stability of the electrical contact and if coil springs are used, these can therefore be protected against overstretching. In a particularly advantageous embodiment, the additional housing part has centering elements that center the contact region within the sleeve. This ensures that in addition the central position of the contact region is maintained.

Electrical contacts are usually produced as turned parts or stamped and bent parts (cut from a flat, conductive material, the desired shape then being produced by repeated bending operations). Stamped contacts are usually less expensive than turned parts, and they are easier to crimp onto an electrical conductor. Turned parts are regarded as being of higher quality, and they can be affixed to wires either by crimping or by soldering. In high voltage/electrical applications heat dissipation is critical, so rotating contacts are also better in this aspect. Because of their complex geometry, stamped contacts are usually difficult to overmold; hence the inventive aspect of the contact.

It is also particularly preferred according to the invention when the faces of the stamped contacts form a continuous surface set. The advantages of this are that a water tightness is achieved with press-fitted or embedded contacts and a plastic overmolding of the contacts is made possible, in which the continuous surface set of the contact, in combination with the walls of an overmolding die, confines the molding compound during the overmolding process.

The electrical contact of the present invention preferably has a continuous enlargement of the outer contour, in order to allow the freedom of movement of the contact region after plastic overmolding. Or it has a narrowing of the inner contour that receives a pin supported in the overmold die, so as to enable in this manner an overmolding within the contact.

It is also preferred if the overmold interface or sealing surface is present on the outer side of a sleeve or of the contacts and/or the overmold interface is present by means of a pin in the die and a taper of the contact downstream of the contact region.

Also part of the present invention is a socket for an electrical connector that comprises at least one inventive electrical contact.

In the following, the invention will be described with reference to drawings, but the invention is not, of course, limited to the illustrated embodiments. In the drawings, FIG. 1 shows a first embodiment of a contact according to the invention with a coil spring as the flexible element;

Figure 1A:
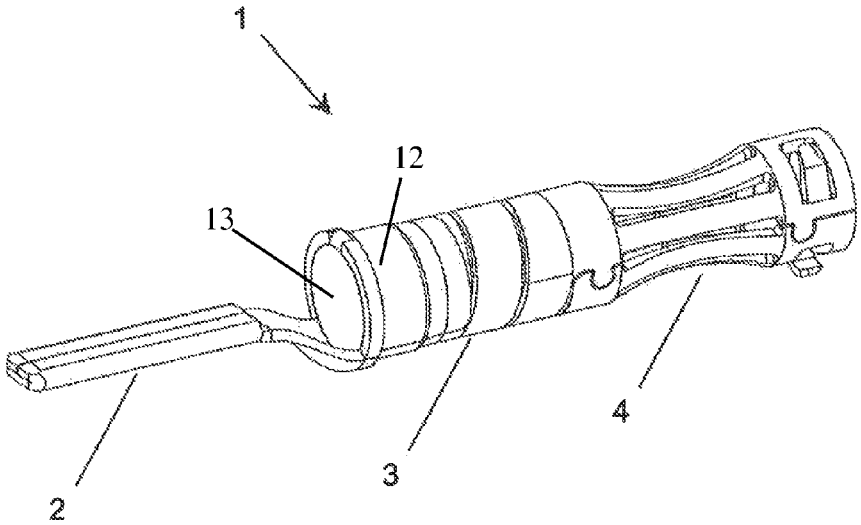
Figure 1B:
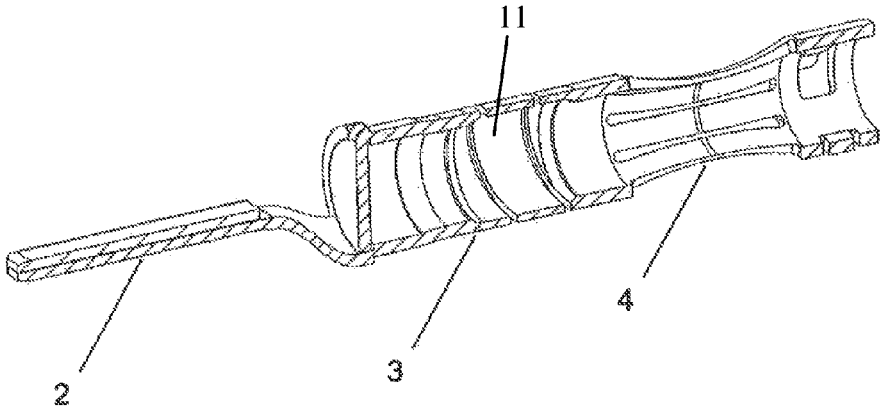

FIG. 1 illustrates a first embodiment of an electrical contact 1 according to the invention, with FIG. 1*a* showing a three-dimensional side view and FIG. 1*b* showing a longitudinal section through the electrical contact. The electrical contact can be divided into the sections of the connecting region 2 and the contact region 4, which are connected to each other by an electrically conductive flexible element 3. The flexible element 3 is formed in this embodiment as a coil spring. The contact region 4 is designed as a socket contact and the connecting region 2 is shown as a 2.8 mm flat contact for a plug connection to the wiring kit.

Figure 2A:
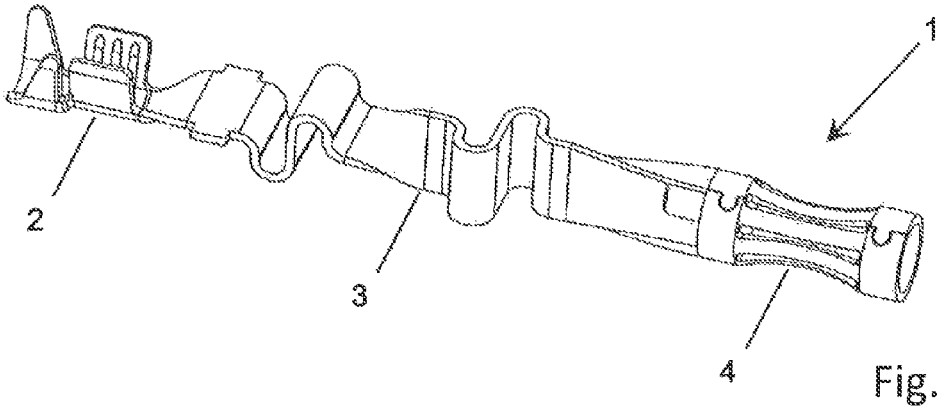
FIG. 2 shows a further embodiment of an electrical contact according to the invention with two orthogonal leaf springs as the flexible element.
Figure 2B:
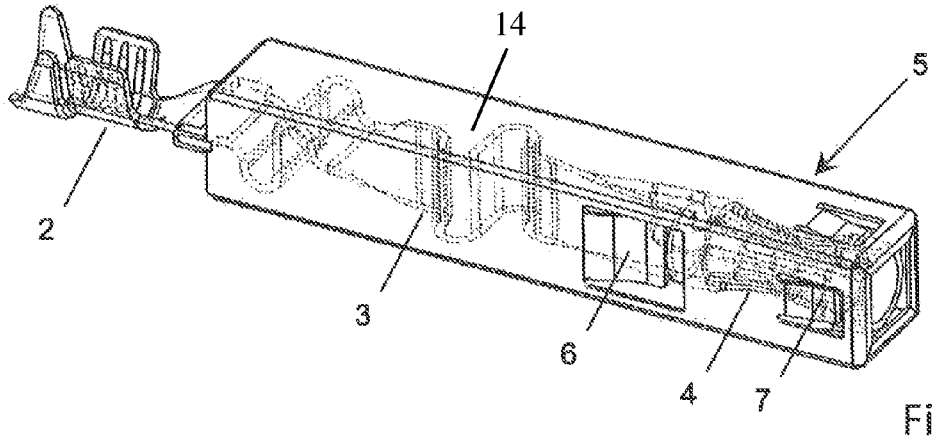
Figure 2C:
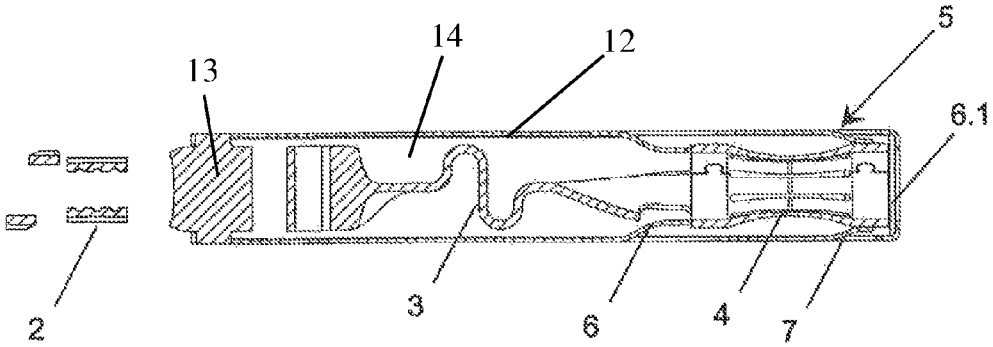

FIG. 2 shows a further embodiment of an electrical contact 1 according to the invention with two orthogonal leaf springs as the flexible element 3. FIG. 2*a* shows a three-dimensional side view of the electrical contact, which can be divided into the sections of the connecting region 2 and contact region 4, which are connected to each other by an electrically conductive flexible element 3. FIG. 2*b* shows the electrical contact 1, which is enclosed in a sleeve 5, with FIG. 2*c* showing a longitudinal section thereof. The contact region 4 is fixed in the sleeve in the axial direction by means of two different stops 6 and 6.1, so that the movement of the contact region 4 in the plugging direction is limited. The stops 6, which are integrated into the sleeve in the form of protrusions, ensure that the movement of the contact region in the axial direction is limited in the direction of the flexible element. The stop 6.1, which is formed on the opposite side of the contact region in the sleeve, ensures that the contact region cannot be pulled out from the housing. Four centering elements 7, which are designed as protrusions of the sleeve, fix the position of the contact region 4 so that it is centered within the sleeve 5.

Figure 3A:
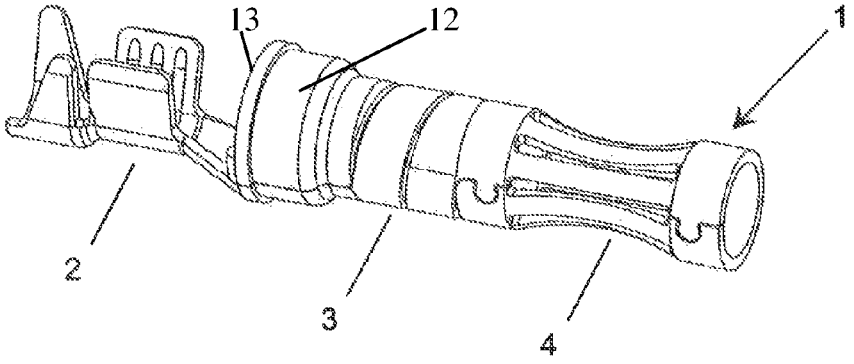
FIG. 3 shows an electrical contact according to the invention with a coil spring as the flexible element, the contact being fixed in a sleeve.
Figure 3B:
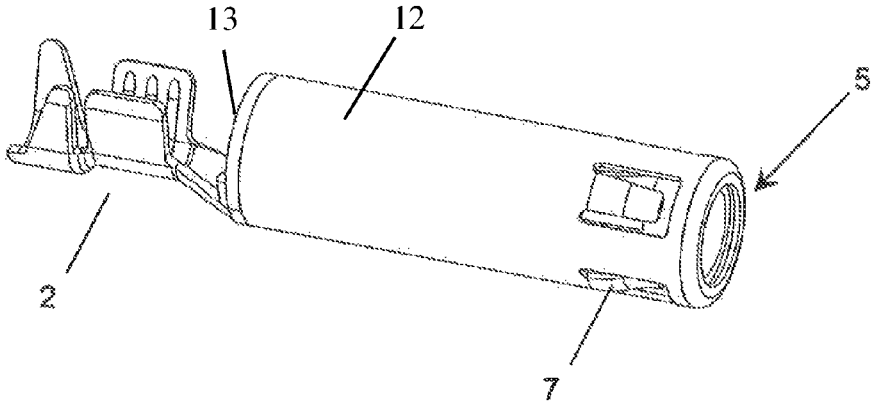
Figure 3C:
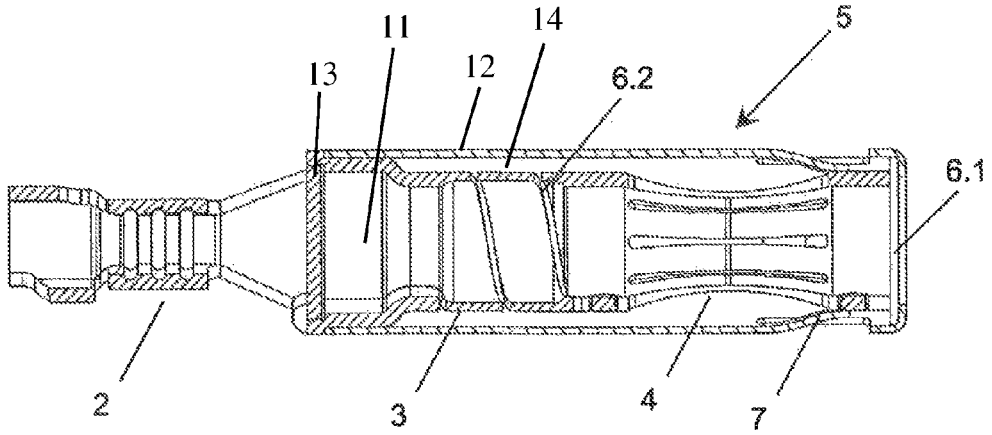

FIG. 3 shows an alternative embodiment to the electrical contact 1 shown in FIG. 2, wherein the flexible element 3 is designed as a coil spring and is likewise enclosed in a sleeve 5. In this embodiment, an alternative stop 6.2 is shown. Same is a component of the coil spring in the flexible element and limits the movement of the contact region in that the coil spring can be compressed only to a limited degree. On the opposite side in the axial direction, the stop 6.1 prevents the electrical contact from being pulled out from the housing. In this embodiment, the maximum thickness of the stamped material of the contact region is 0.5 mm. Thus, the distance between the coil spring (stop 6.2) and the contact region 4 is approximately 0.1 mm. On the opposite side, between the stop 6.1 and the contact region 4 the distance is approximately 0.3 mm. Therefore, due to manufacturing tolerances, an overall movement of the contact region in the axial direction (parallel to the insertion direction) of only about 0.1 to 0.4 mm is possible.

In this embodiment it is also apparent that the surfaces of the stamped contacts form a continuous surface set, whereby water tightness is achieved with press-fitted or embedded contacts.

Figure 4:
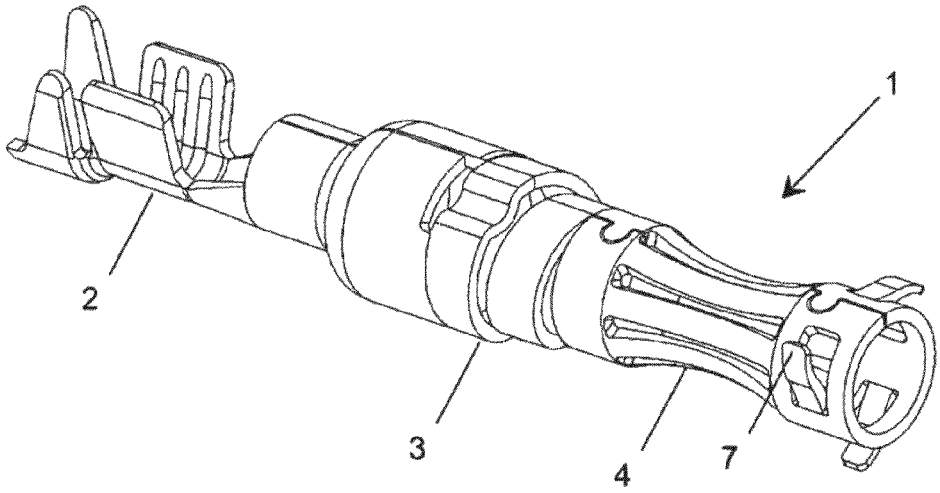
FIG. 4 shows a further embodiment of an electrical contact with centering elements, the electrical contact being fixed in an overmolding.
Figure 4:
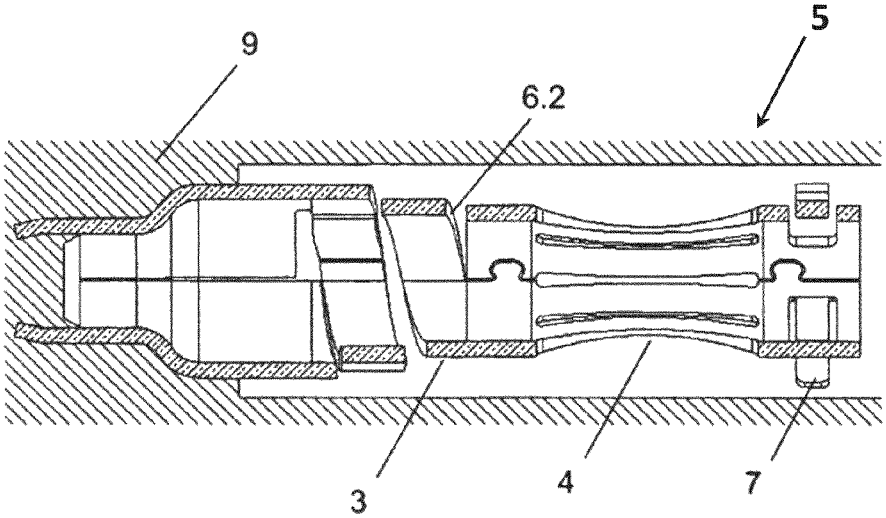

FIG. 4 shows a further alternative embodiment of the inventive electrical contact 1 with a rigidly designed coil spring as the flexible region, the three centering elements 7 being part of the electrical contact and integrated into the contact region 4. In this embodiment the connecting region 2 is fixed in a plastic overmolding 9, for example in a power socket housing. The flexible element 3 is designed as a coil spring that is of rigid design due to the rectangular cross-section, so that no counter-stop need be present. This rigidity of the spring protects the flexible element from overstretching and the contact region from moving in the plugging direction.

The surfaces of the stamped contacts of this embodiment likewise form a continuous surface set, so as to permit plastic overmolding of the contacts, in which the continuous surface set of the contact in combination with the walls of an overmold die, confines the molding compound during the overmolding process.

The inner boundary of the overmolding 9 in FIG. 4*b* is produced by means of a pin in the die, which pin is small enough to fit through the contact region 4.

Figure 5A:
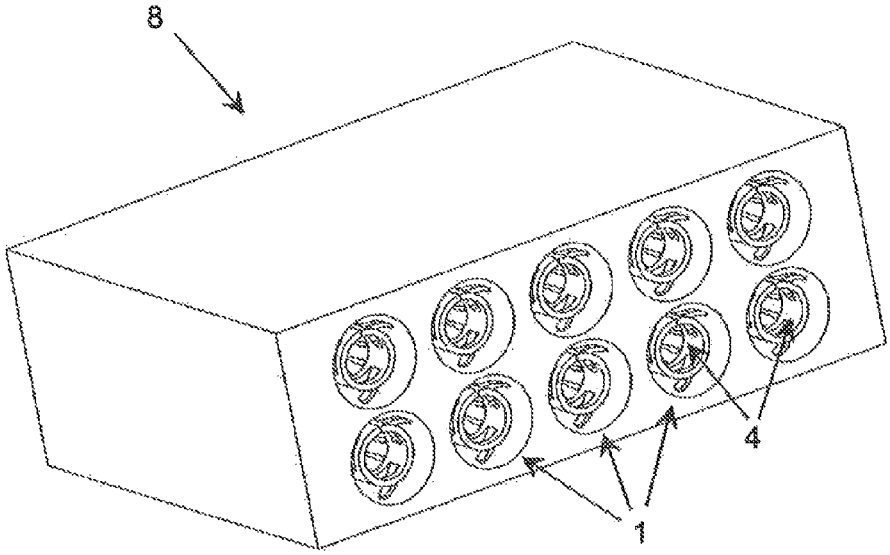
FIG. 5 shows a socket with electrical contacts according to FIG. 1.
Figure 5B:
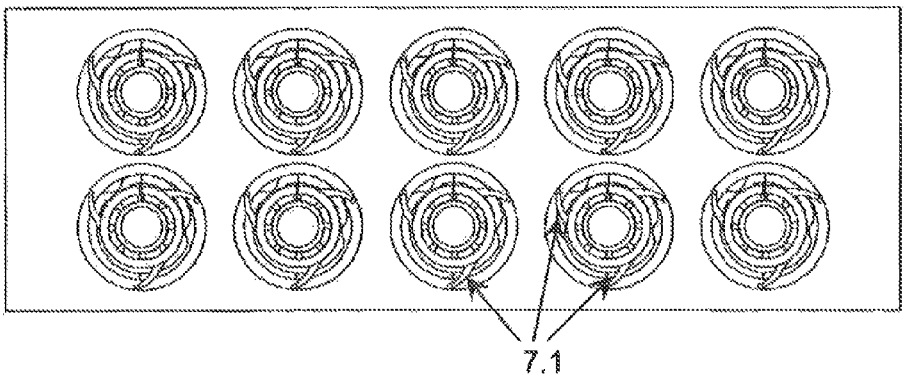

FIG. 5 shows a three-dimensional side view (FIG. 5*a*) and a plan view (FIG. 5*b*) of a power socket 8 according to the invention, in which ten electrical contacts 1 are integrated according to FIG. 4*a*. Three centering elements 7.1 within each contact region 4 ensure that the contact region is centered within the sleeves of the socket and at the same time function as stops to limit the axial movement of the contact region. For this purpose, the outer edges of the centering elements 7.1 are designed with sharp edges.

Figure 6A:
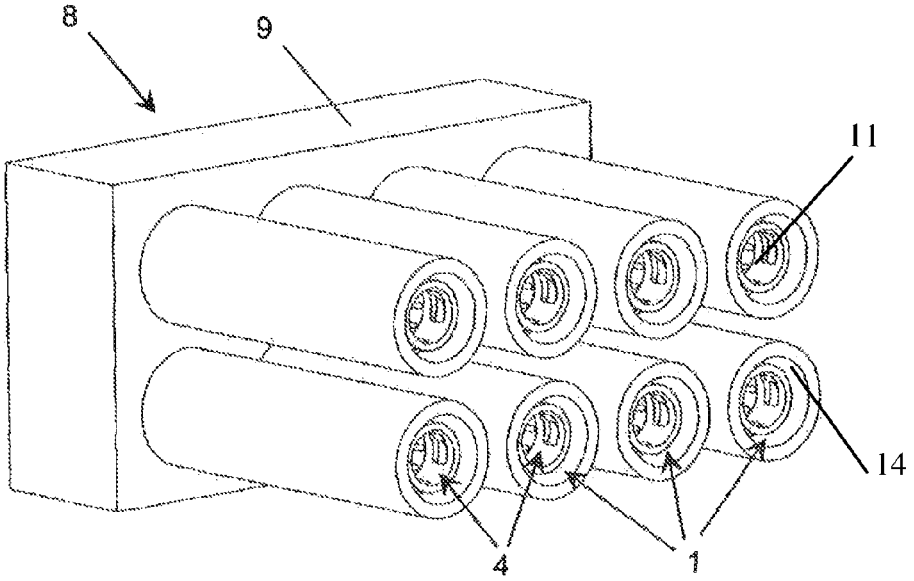
FIGS. 6 and 7 show an alternative embodiment of a power socket with electrical contacts according to FIG. 1.
Figure 6B:
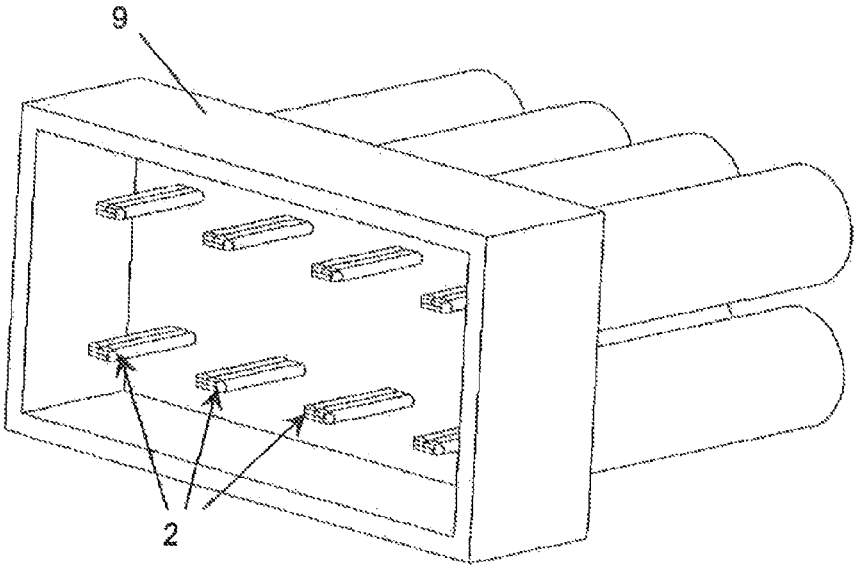
Figure 7:
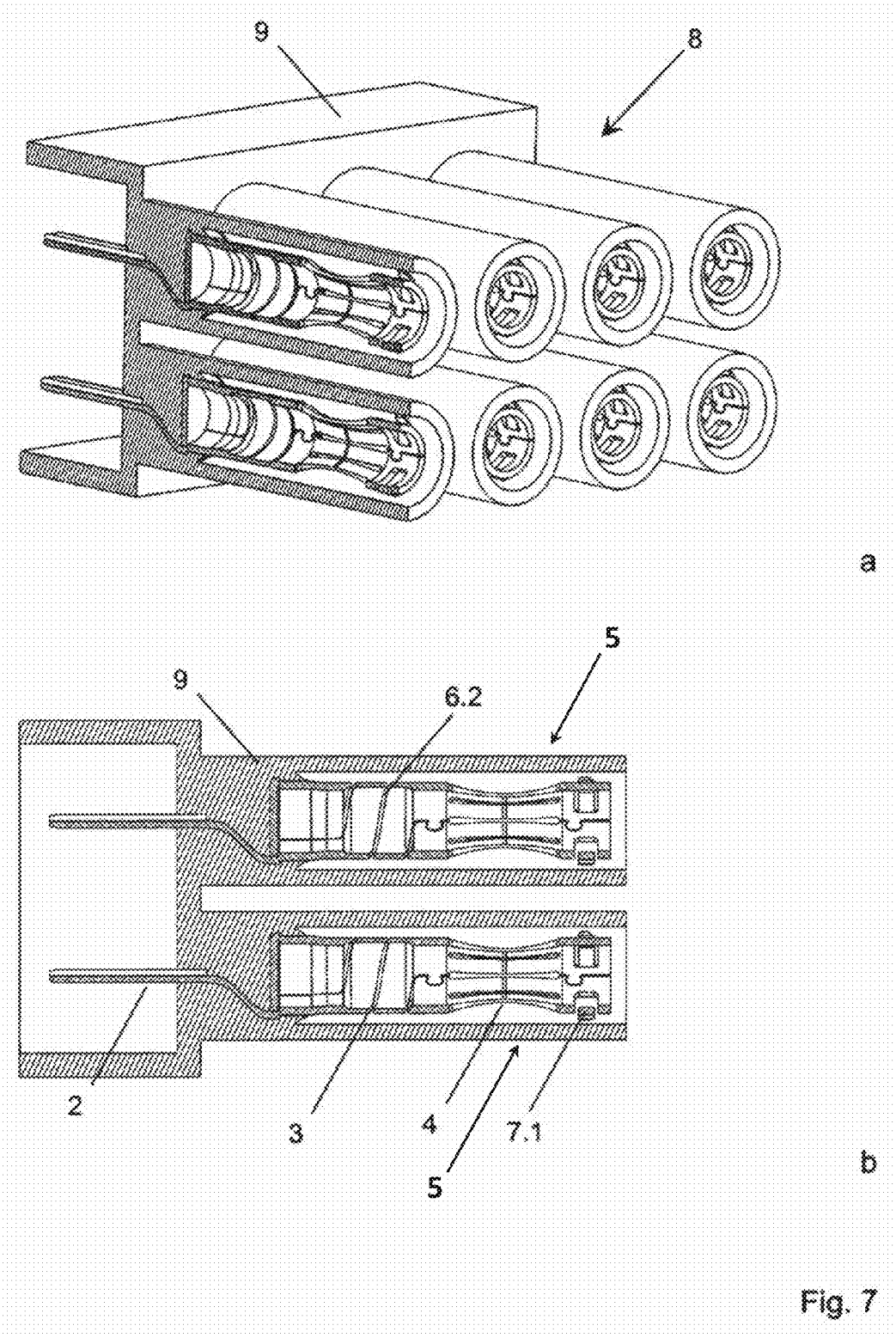

FIGS. 6 and 7 show an alternative embodiment of a power socket 8 with electrical contacts 1 according to FIG. 1. In this arrangement, eight electrical contacts, each of which can be divided into a connecting region 2 (2.8 mm flat contact), an electrically conductive flexible element 3, and a contact region 4, are enclosed in a socket housing 9. Inside this housing 9, the connecting region 2 of the electrical contacts is fixed in a plastic overmolding or press fit housing. Fixing of the connecting region 2 within a plastic overmolding or press fit housing is achieved by combining the surfaces of the contact and the housing through an overmolding or press-fit process to form a continuous surface set 12 in the area which extends between the contact region 4 and the connecting region 2. The continuous surface set 12 does not contain any gaps or open paths traces from the area facing the contact region to the area facing the connecting region. The contact region 4 remains movable in the flexible element 3 in the non-axial direction due to the coil spring and is centered within the sleeves of the socket housing by centering elements 7.1 which also at the same time can function as stops to limit the movement of the contact region in the axial direction. The stop 6.2 is an integral part of the coil spring in the flexible element and limits the movement of the contact region in that the coil spring can be compressed only to a limited degree, since it is of rigid design due to the rectangular cross section.

The surfaces of the stamped contacts of this embodiment also form a continuous surface set, so as to permit a plastic overmolding of the contacts, in which the continuous surface set of the contact in combination with the walls of an overmolding die, confines the molding compound for overmolding.

Figure 8A:
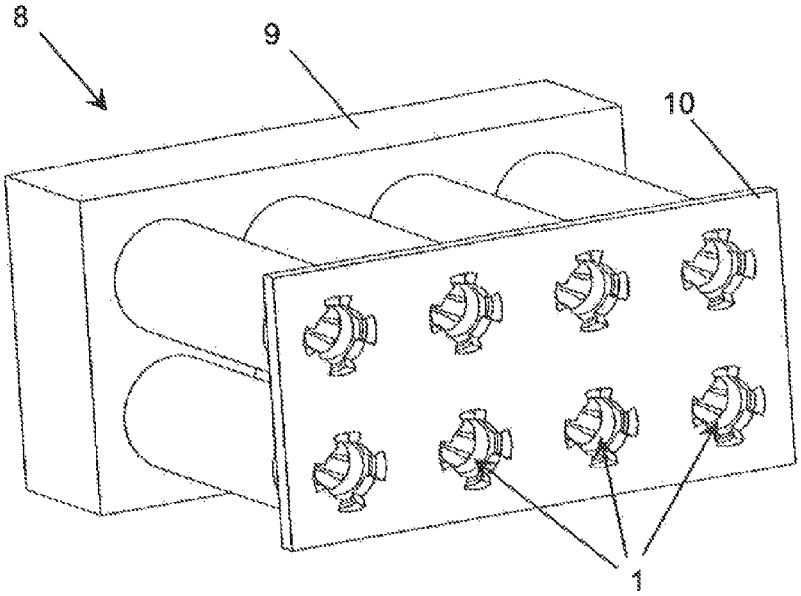
FIGS. 8 and 9 show another alternative embodiment of a power socket with an additional housing part.
Figure 8B:
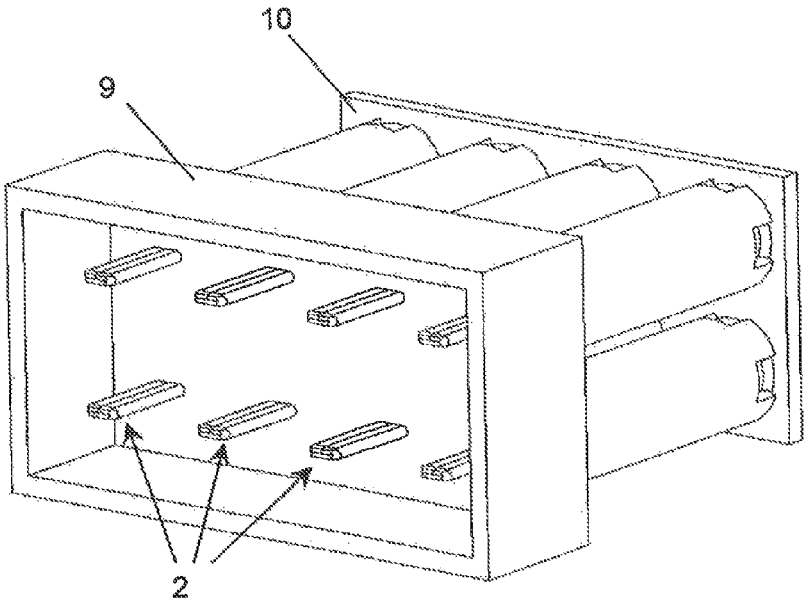
Figure 9:
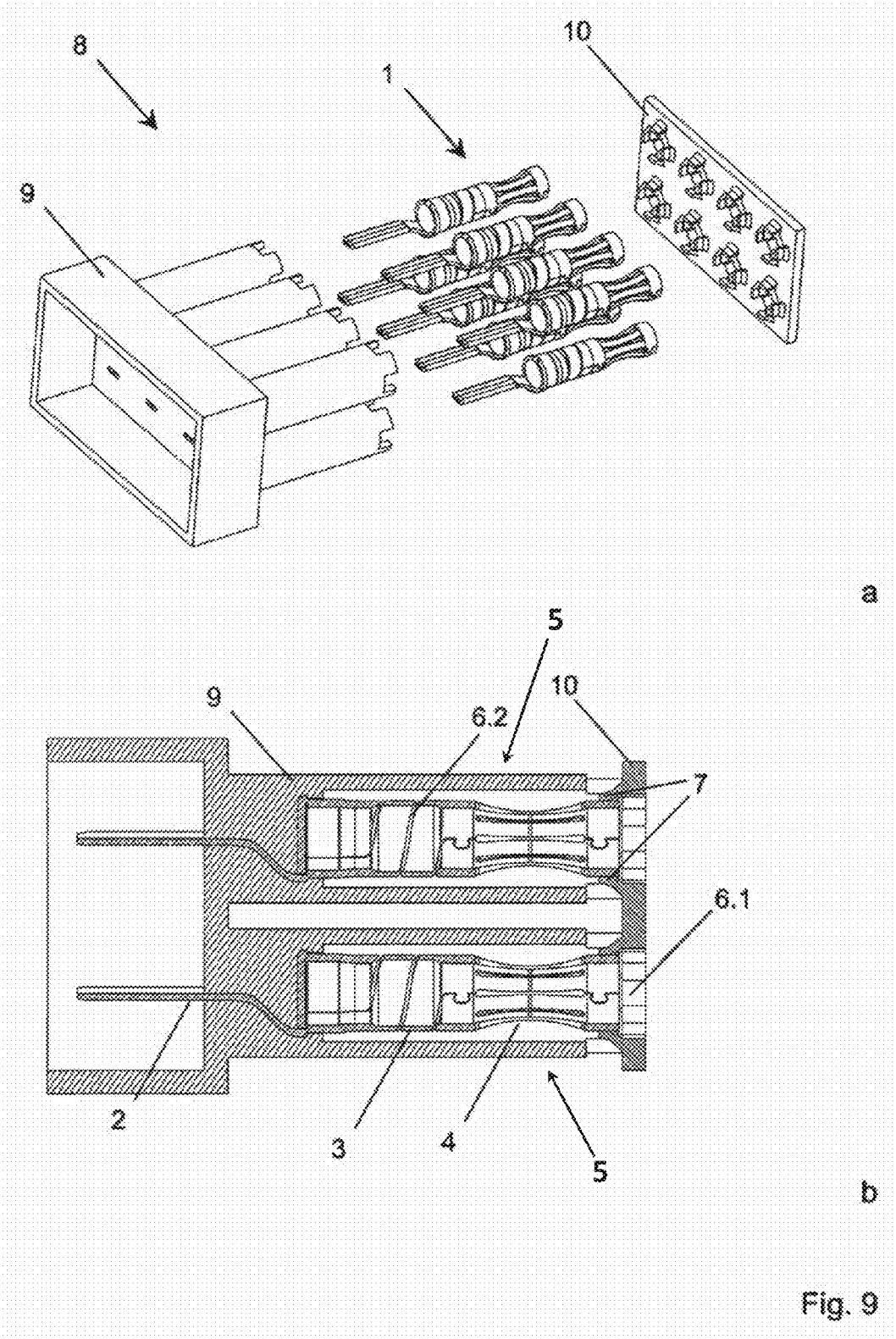

FIGS. 8 and 9 show another alternative embodiment of a power socket 8 with eight electrical contacts 1 that can each be divided into a connecting region 2 (2.8 mm flat contact), an electrically conductive flexible element 3 and a contact region 4. In this embodiment, an additional housing part 10 is provided that prevents movement of the contact region 4 by means of stops 6.1. Additional stops 6.2 also limit the movement of the contact region in the axial direction. The connecting region 2 of the electrical contacts is additionally fixed in a plastic overmolding. The additional housing part 10 also includes centering elements 7, which ensure that the contact region 4 is centered within the socket housing 9.

Figure 10A:
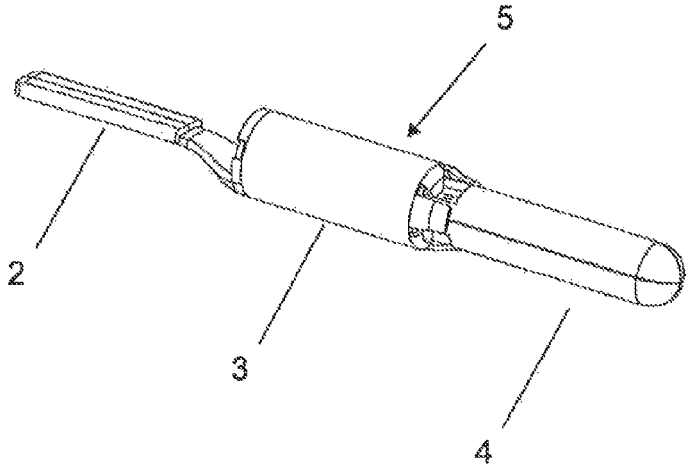
FIG. 10 shows a further embodiment of an electrical pin contact
Figure 10B:
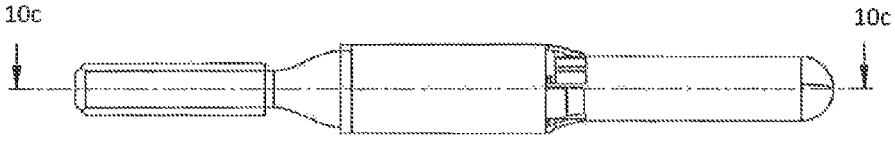
Figure 10C:
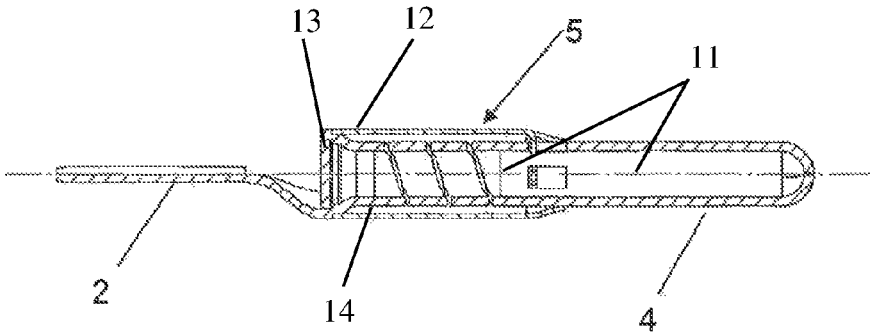

FIG. 10 shows another embodiment of an electrical pin contact 1, with FIG. 10*a* showing a three-dimensional side view and FIGS. 10*b-c* showing a longitudinal section through the electrical pin contact. The electrical pin contact can be divided into the sections of the connecting region 2 and contact region 4, which are connected to each other by an electrically conductive flexible element 3. The flexible element 3 is designed in this embodiment as a coil spring and is enclosed in a sleeve 5.

Embodiments of the electrical contact described herein include a hollow space (11) inside the contact, a tubular face (12), an end face (13) and a hollow space (14) which contains the flexible element. These features are illustrated within at least FIGS. 1*a*, 1*b*, 2*b*, 2*c*, 3*a*, 3*b*, 3*c*, 4*b*, 6*a*, 7*a*, 7*b*, 9*b* and 10*c*.

LIST OF REFERENCE NUMERALS

1 electrical contact
2 connecting region of the electrical contact
3 flexible element of the electrical contact
4 contact region of the electrical contact
5 sleeve
6 stop that is designed as a protrusion
6.1 stop that also forms the end of the housing
6.2 stop that is formed by a coil spring
7 centering element
7.1 sharp-edged centering element that also functions as a stop
8 power socket
9 housing of the power socket
10 additional housing part
11 a hollow space inside the contact
12 a tubular face
13 an end face
14 a hollow space which contains the flexible element

What is claimed is:

1. An electrical contact comprising a round cross section for an electrical plug connection, said electrical contact being mounted within a housing and having a flexible element between a connecting region and a movable contact region wherein:

the connecting region is fixed in the housing within an overmolding or by means of press-fitting, the contact region comprises one of an electrical pin or a socket contact, the electrical pin or socket contact having a continuous and water tight combination of surfaces between the flexible element and the connecting region formed from a tubular face and an end face, the tubular face including or enclosing the flexible element, the flexible element with or without the contact region being enclosed in a portion of the housing comprising a sleeve;

movement of the contact region and deformation of the flexible element along an axis parallel to a plugging direction of the contact region is significantly limited or prevented by at least one stop, but movement and deformation in any direction orthogonal to the plugging direction is possible, the electrical contact is designed in one piece, the electrical contact is stamped and the combined surfaces of the tubular face and end face of the electrical pin or socket contact and/or housing form a continuous and water tight surface set and create a hollow space which contains the flexible element that allows a sleeve to be formed around the flexible element with or without the contact region, through an overmolding process or a press fit to obtain a flexible element with or without the contact region, enclosed within the sleeve such that the electrical pin or socket contact does not allow a molding compound to enter within a hollow space inside the electrical pin or socket contact during the overmolding process and the hollow space containing the flexible element with or without the contact region is preserved if the electrical pin or socket contact is installed in the housing by means of a press fit, thus allowing movement of the flexible element inside of the hollow space and/or sleeve, said flexible element is designed in a form of a coil spring or said flexible element being designed in a form of two orthogonal leaf springs.

2. The electrical contact according to claim 1, wherein the electrical contact has an overmolding interface or a sealing surface, the overmolding interface or the sealing surface being present on the outer side of a sleeve or of the electrical pin or socket contact.

3. The electrical contact according to claim 1, wherein the electric pin or socket contact consists of an electric socket contact and wherein the overmolding interface is present by means of a pin in the overmold die and by means of a taper of the electrical socket contact downstream of the contact region.

4. The electrical contact according to claim 1, wherein the electrical contact is enclosed in a sleeve, and movement and/or deformation of the flexible element of the electrical contact is limited by means of stops, the stops preferably being integrated into the sleeve.

5. The electrical contact according to claim 1, wherein movement of the contact region of the electrical contact is limited by means of at least one stop and wherein at least one stop is formed by a coil spring as a part of the flexible element.

6. The electrical contact according to claim 1, wherein flexible centering elements center the contact region of the electrical contact within the sleeve, the centering elements preferably being integrated into the sleeve and the centering elements being integrated into the contact region, and the centering elements being designed with sharp edges, so that they function at the same time as stops.

7. The electrical contact according to claim 1, wherein the sleeve is made of an elastic material.

8. The electrical contact according to claim 1, wherein movement of the contact region of the electrical contact is limited by an additional housing part and in that centering elements that center the contact region within the sleeve are integrated into the additional housing part.

9. The electrical contact according to claim 1, wherein the electric pin or socket contact consists of an electric socket contact and wherein the electrical contact has a continuous enlargement of the outer contour, in order to allow the freedom of movement of the contact region after plastic overmolding, and/or has a taper of the inner contour that accommodates a pin supported in the overmold die, so as to enable overmolding within the electrical socket contact.

10. The electrical contact according to claim 1, wherein the flexible element is designed in the form of a coil spring and a cross section of the coil spring is rectangular.

* * * * *